US012156577B2

(12) United States Patent
Song

(10) Patent No.: US 12,156,577 B2
(45) Date of Patent: Dec. 3, 2024

(54) CURLING IRON CAPABLE OF CURLING HAIR IN TWO DIRECTIONS

(71) Applicant: Xiuhong Song, Shenzhen (CN)

(72) Inventor: Xiuhong Song, Shenzhen (CN)

( * ) Notice: Subject to any disclaimer, the term of this patent is extended or adjusted under 35 U.S.C. 154(b) by 0 days.

(21) Appl. No.: 18/242,671

(22) Filed: Sep. 6, 2023

(65) Prior Publication Data

US 2023/0404231 A1 Dec. 21, 2023

Related U.S. Application Data

(63) Continuation of application No. PCT/CN2022/088457, filed on Apr. 22, 2022.

(30) Foreign Application Priority Data

Jan. 21, 2022 (CN) ..... 202220162052.9

(51) Int. Cl.
*A45D 2/36* (2006.01)
*A45D 2/00* (2006.01)
*A45D 20/10* (2006.01)

(52) U.S. Cl.
CPC ..... *A45D 2/00* (2013.01); *A45D 2/367* (2013.01)

(58) Field of Classification Search
CPC ..... A45D 20/50; A45D 20/52; A45D 20/525; A45D 2/367; A45D 2/36; A45D 20/10
See application file for complete search history.

(56) References Cited

U.S. PATENT DOCUMENTS

2015/0265024 A1* 9/2015 Maclaine ..... A46B 9/023 132/271
2023/0380565 A1* 11/2023 Tibbetts ..... A45D 20/124

FOREIGN PATENT DOCUMENTS

| | | | |
|---|---|---|---|
| CN | 206166088 | U | 5/2017 |
| CN | 206979037 | U | 2/2018 |
| CN | 111887565 | A | 11/2020 |
| CN | 213757031 | U | 7/2021 |
| CN | 215347414 | U | 12/2021 |
| CN | 215423230 | U | 1/2022 |
| TW | M315525 | U | 7/2007 |
| TW | M405191 | U | 6/2011 |

(Continued)

*Primary Examiner* — Tatiana L Nobrega
(74) *Attorney, Agent, or Firm* — Daniel M. Cohn; Howard M. Cohn

(57) ABSTRACT

A curling iron capable of curling hair in two directions relates to the field of curling irons. The curling iron includes a rotary outer shell, a rotating body, and a fixing knob. The rotating body is sleeved in the rotary outer shell, and the fixing knob is disposed at a top of the rotary outer shell and connected with the rotating body. The rotary outer shell includes a ventilation rod body, and an air duct cover sheet. The air duct cover sheet is clamped on a surface of the ventilation rod body. The rotating body includes a partition plate and a ventilation bottom cover. The partition plate is disposed on the ventilation bottom cover. Ventilation is carried out by the ventilation rod body in cooperation with the cover sheet, and the rod body is of a rotary structure, so that air may be adjustably blown out in two directions by a cooperation of the rotary rod body and the rotating body, without replacing heads of the curling iron with different air outlet directions. This achieves a purpose of curling and dressing hair with air blown in two directions.

1 Claim, 4 Drawing Sheets

(56) References Cited

FOREIGN PATENT DOCUMENTS

| | | | |
|---|---|---|---|
| TW | M441376 | U | 11/2012 |
| WO | 2021075642 | A1 | 4/2021 |

* cited by examiner

CURLING IRON CAPABLE OF CURLING HAIR IN TWO DIRECTIONS

TECHNICAL FIELD

The invention relates to the field of curling irons, and in particular, to a curling iron capable of curling hair in two directions.

BACKGROUND

A curling iron is a DIY tool for hairdressing. Hairdressers in hair salons and barber shops use a set of curling iron tools. The tool usually includes several components, such as a heating component, a handle, a power cord, and a temperature control system. Effect of a curling iron with a temperature adjustment function is better than that of a curling iron without a temperature adjustment function. Various curls may be made by using the curling iron, such as big wavy hair, drooping natural curls, curls falling to the shoulders, disconnected curls, wheat ear curls, inverted curls, and everted curls.

The existing curling iron with a ventilation function is usually used in one direction during curling. Air is blown out to curl hair only in one direction, and wound hair is permed by hot air. However, in an actual process, hair needs to be curled in a plurality of directions. When such air-blowing curling iron is used, another head of the curling iron in another direction needs to be replaced for use. This not only affects efficiency, but also affects actual modeling effect.

SUMMARY

Aiming at defects or deficiencies in a conventional technology, the invention provides a curling iron capable of curling hair in two directions. Ventilation is carried out by the ventilation rod body in cooperation with the cover sheet, and the rod body is of a rotary structure, so that air may be adjustably blown out in two directions by a cooperation of the rotary rod body and the rotating body, without replacing heads of the curling iron with different air outlet directions. This achieves a purpose of curling and dressing hair with air blown in two directions.

To implement the foregoing objectives, the invention uses the following technical solutions: A curling iron capable of curling hair in two directions includes a rotary outer shell, a ventilation handle, and a fixing knob. The rotating body is sleeved in the rotary outer shell, and the fixing knob is disposed at a top of the rotary outer shell and connected with the ventilation handle. The rotary outer shell includes a ventilation rod body, and an air duct cover sheet. The air duct cover sheet is clamped on a surface of the ventilation rod body. The rotating body includes a partition plate and a ventilation bottom cover. The partition plate is disposed on the ventilation bottom cover.

The ventilation rod body includes a plurality of arc-shaped plates, and air outlets are symmetrically disposed on both sides of the arc-shaped plate.

A first fixing groove is disposed between the arc-shaped plates, and the first fixing groove is protruded toward the surface of the ventilation rod body.

A partition block is disposed between the air outlets.

A first fixing strip, a second fixing strip, and a second fixing groove are disposed in a concave surface of the air duct cover sheet. The second fixing groove is disposed between the first fixing strip and the second fixing strip.

A width of the first fixing groove is larger than a thickness of the partition plate, and the partition plate is movably connected with the first fixing groove.

The second fixing groove is connected with a bump of a first fixing groove.

A fixed clamping head is disposed on an outer side of the ventilation bottom cover.

A quantity of the arc-shaped plates corresponds to a quantity of the air duct cover sheets.

After the technical solutions are adopted, the invention has the following beneficial effects: Ventilation is carried out by the ventilation rod body in cooperation with the cover sheet, and the rod body is of a rotary structure, so that an air outlet direction may be adjusted by a cooperation of the rotary rod body and the rotating body, without replacing heads of the curling iron with different air outlet directions. This achieves a purpose of curling and dressing hair through the curling salon capable of curling hair in two directions.

BRIEF DESCRIPTION OF DRAWINGS

To describe the technical solutions in the embodiments of the invention or in the prior art more clearly, the accompanying drawings required to describe the embodiments or the prior art are briefly described below. It is obvious that the accompanying drawings described below are only some embodiments recorded in the invention. It is apparent to those of ordinary skill in the art that other drawings may be further obtained based on the accompanying drawings without creative effort.

Figure 1:
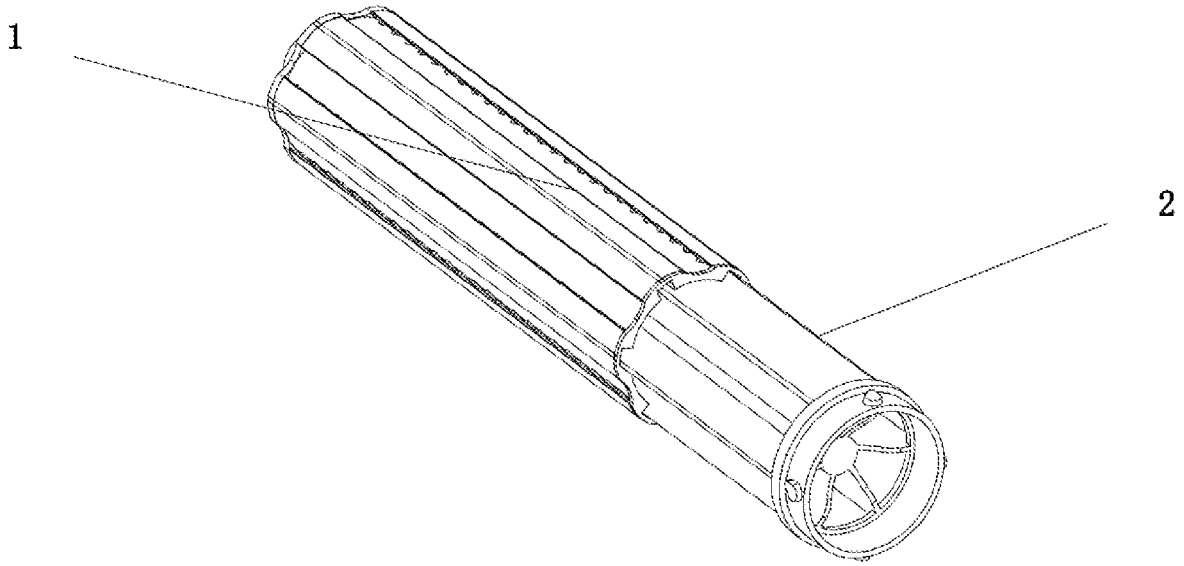
FIG. 1 is a schematic diagram of a structure according to the invention.

REFERENCE NUMERALS rotary outer shell 1, rotating body 2, fixing knob 3, ventilation rod body 1-1, air duct cover sheet 1-2, partition plate 2-1, ventilation bottom cover 2-2, fixed clamping head 2-3, arc outlet 1-1-1, first fixing groove 1-1-2, air outlet 1-1-3, partition block 1-1-4, first fixing strip 1-2-1, second fixing strip 1-2-2, and second fixing groove 1-2-3.

DETAILED DESCRIPTION

Figure 2:
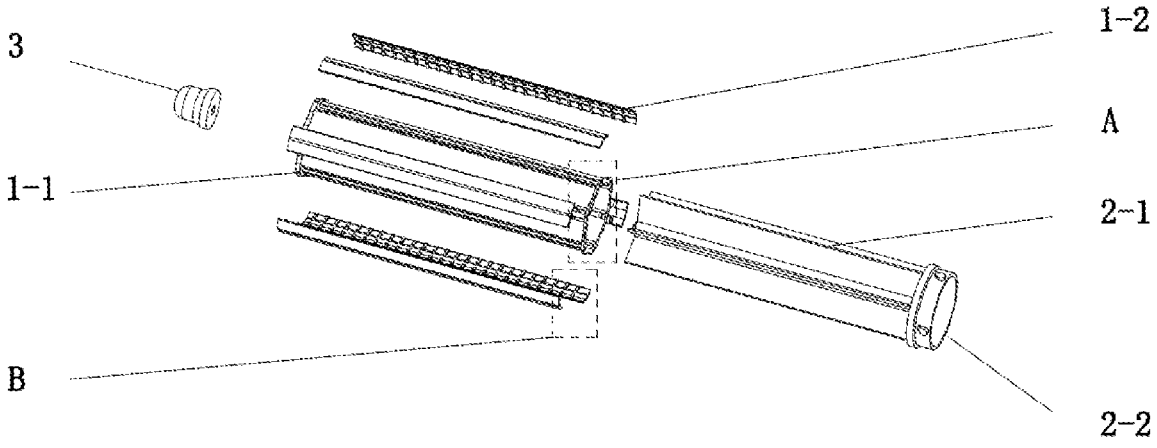
FIG. 2 is a schematic diagram of an exploded structure according to the invention.
Figure 3:
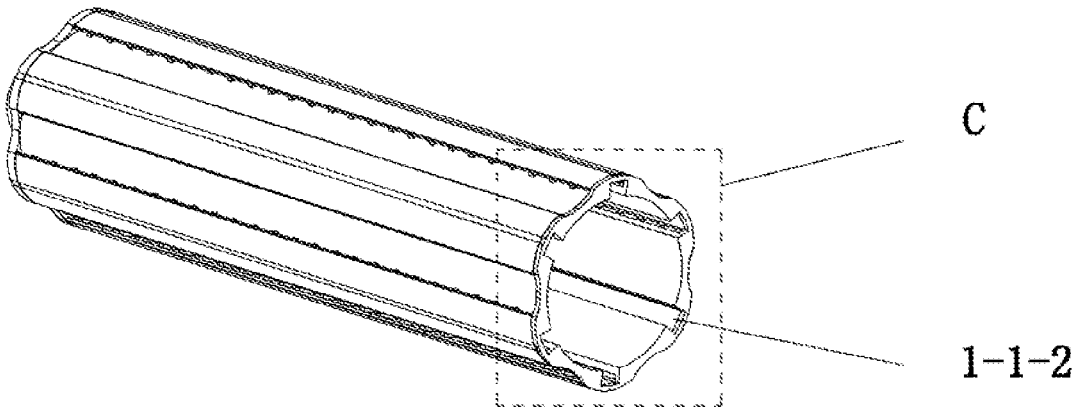
FIG. 3 is a schematic diagram of a structure of a rotary outer shell 1 according to the invention.
Figure 4:
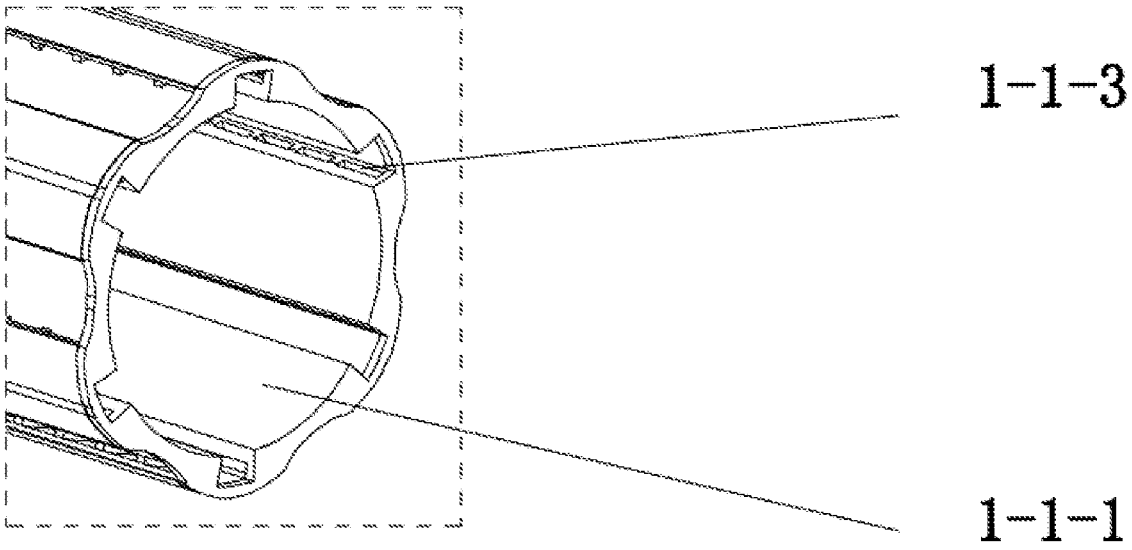
FIG. 4 is a schematic diagram of an enlarged structure of C in FIG. 3.
Figure 5:
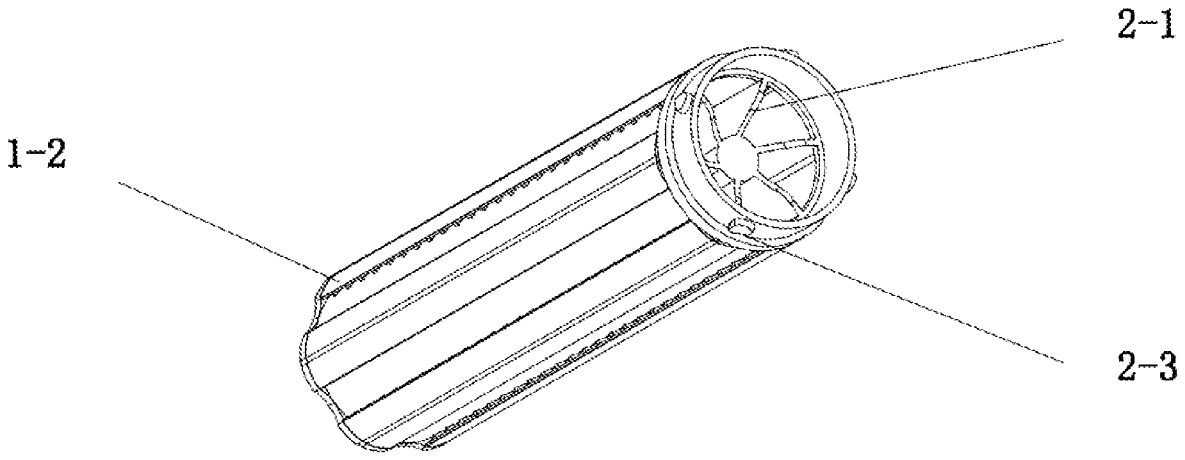
FIG. 5 is an assembly diagram of the invention.
Figure 6:
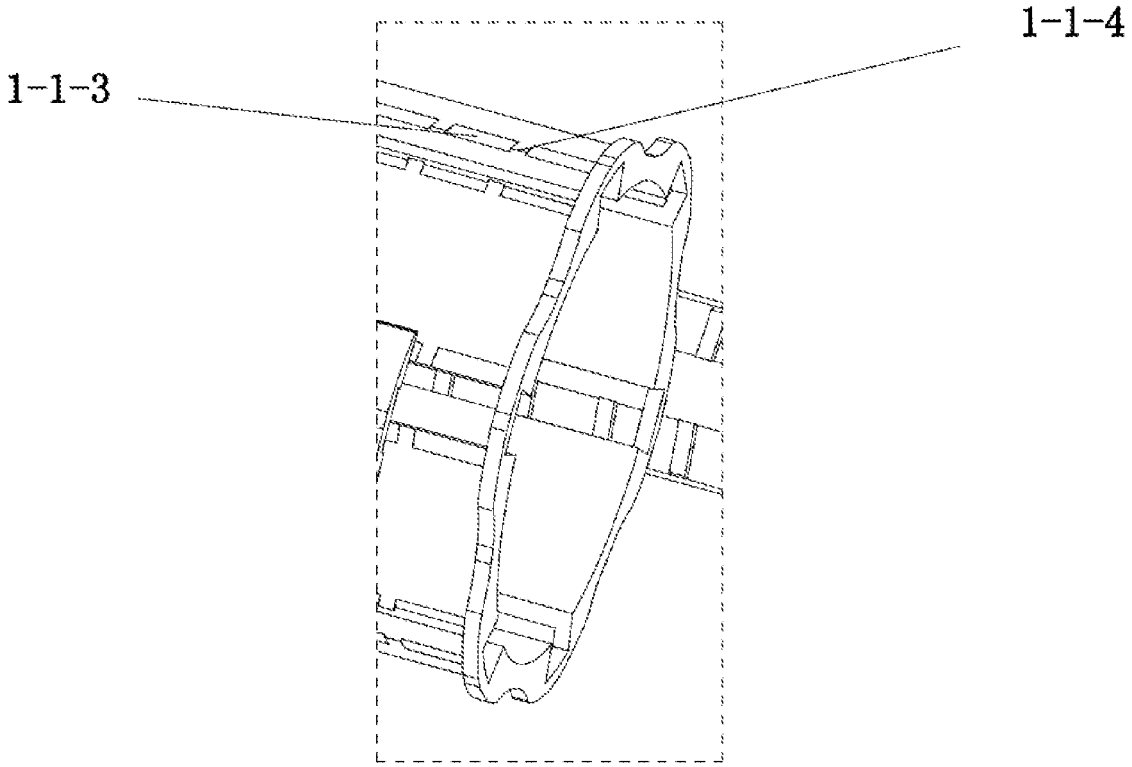
FIG. 6 is a schematic diagram of an enlarged structure of A in FIG. 1.
Figure 7:
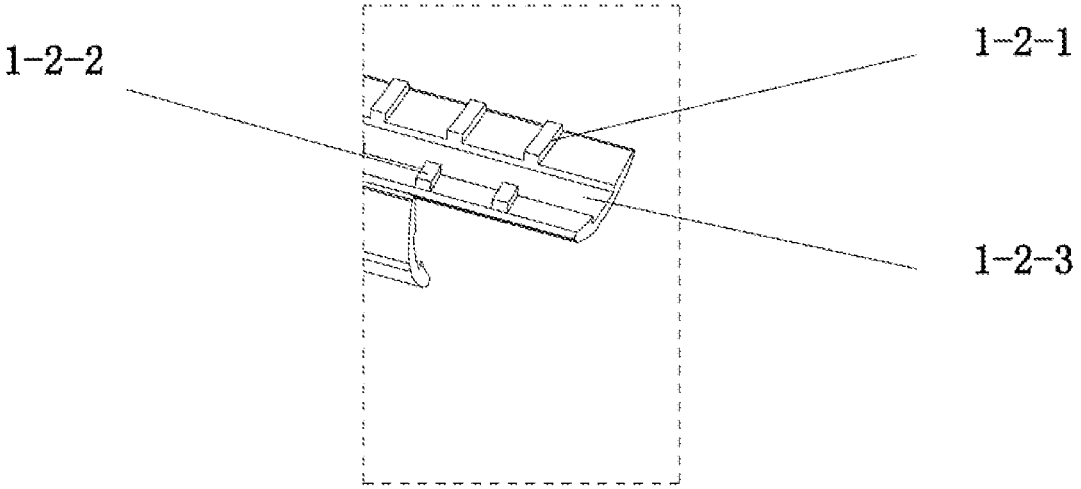
FIG. 7 is a schematic diagram of an enlarged structure of B in FIG. 1.

Referring to FIG. 1 to FIG. 7. Technical solutions used in specific embodiments are as follows: A curling iron capable of curling hair in two directions includes a rotary outer shell 1, a rotating body 2, and a fixing knob 3. The rotating body 2 is sleeved in the rotary outer shell 1, and the fixing knob 3 is disposed at a top of the rotary outer shell 1 and connected with the rotating body 2. The rotary outer shell 1 includes a ventilation rod body 1-1, and an air duct cover sheet 1-2. The rotating body 2 includes a partition plate 2-1 and a ventilation bottom cover 2-2. The partition plate 2-1 is disposed on the ventilation bottom cover 2-2. The air duct cover sheets 1-2 are clamped on a surface of the ventilation rod body 1-1, where each air duct cover sheet is secured to one of a plurality of partition blocks 1-1-4 disposed on the outer surface of the rotary shell between the air exits of the first and second rows of air outlets. The ventilation rod body 1-1 includes a plurality of arc-shaped plates 1-1-1, and a plurality of elongated segments (unlabeled), where the plurality arc-shaped plated and the plurality of elongated segments are arranged in an alternating manner such that their respective inner and outer surfaces are continuous and define inner and outer surfaces of the rotary outer shell. Each elongated segment of the plurality of elongated segments includes a first fixing groove 1-1-2 on an inner surface of the elongated segment where the first fixing groove extends along the length of the segment and is disposed between two adjacent ones of the arc-shaped plates 1-1-1. Air outlets 1-1-3 are symmetrically disposed on both sides of the arc-shaped plate 1-1-1. A quantity of the arc-shaped plates 1-1-1 corresponds to a quantity of the air duct cover sheets 1-2. When the rotating body 2 is rotated, the partition plate 2-1 may move between the first fixing grooves 1-1-2. When the partition plate is close to the air outlet 1-1-3 on any side, air flow from a blowing mechanism enters from the ventilation bottom cover 2-2, is separated by the partition plate 2-1, blown out from the air outlet 1-1-3 on the other side, pressed toward both sides through the air duct cover sheet 1-2, and then blown out. Therefore, air may be blown out from the curling iron, so that the curling iron may be conveniently used by one hand in a daily curling process. This improves curling efficiency.

Further, a partition block 1-1-4 is disposed between the air outlets 1-1-3. A first fixing strip 1-2-1, a second fixing strip (1-2-2), and a second fixing groove 1-2-3 are disposed in a concave surface of the air duct cover sheet 1-2. The second fixing groove (1-2-3) is disposed between the first fixing strip 1-2-1 and the second fixing strip 1-2-2. The partition block 1-1-4 limits the first fixing strip 1-2-1 and the second fixing strip 1-2-2, to prevent the air duct cover sheet 1-2 from moving.

Further, a width of the first fixing groove 1-1-2 is larger than a thickness of the partition plate 2-1, and the partition plate 2-1 is movably connected with the first fixing groove 1-1-2. Because the thickness of the partition plate 2-1 is smaller than the width of the first fixing groove 1-1-2, when the rotating body 2 is rotated, the partition plate 2-1 may move between the first fixing grooves 1-1-2.

Further, the second fixing groove 1-2-3 is connected with a bump of a first fixing groove 1-1-2.

Further, a fixed clamping head 2-3 is disposed on an outer side of the ventilation bottom cover 2-2. The fixed clamping head 2-3 is configured to connect and fix a blowing device.

A working principle of the invention is as follows: The quantity of arc-shaped plates 1-1-1 and the quantity of air duct cover plates 1-2 are set based on an actual requirement, to achieve different air outlet effect. The air duct cover piece 1-2 is disposed on the ventilation rod body 1-1, the second fixing groove 1-2-3 is connected with the bump of the first fixing groove 1-1-2 and is clamped on the first fixing groove 1-1-2 through the first fixing strip 1-2-1 and the second fixing strip 1-2-2, and the partition block 1-1-4 limits the first fixing strip 1-2-1 and the second fixing strip 1-2-2 to prevent the air duct cover sheet 1-2 from moving. The rotating body 2 is sleeved in the rotary outer shell 1, and the partition plate 2-1 is inserted into the first fixing groove 1-1-2. Because the thickness of the partition plate 2-1 is small than the width of the first fixing groove 1-1-2, when the rotating body 2 is rotated, the partition plate 2-1 may move between the first fixing grooves 1-1-2. When the partition plate is close to the air outlet 1-1-3 on any side, air flow from a blowing mechanism enters from the ventilation bottom cover 2-2, is separated through the partition plate 2-1, and blown out from the air outlet 1-1-3 on the other side. Therefore, an air outlet direction may be adjusted by the rotating body 2, so that air may be adjustably blown out from the curling iron, which greatly facilitates daily curling. This improves curling efficiency.

The foregoing descriptions are only used to describe the technical solutions of the present disclosure, but are not limited thereto. Any modification, equivalent replacement made by ordinary technicians for the technical solutions of the invention within the spirit and principle of the invention should be included within the scope of the claims of the invention.

What is claimed is:

1. A curling iron capable of curling hair in two directions, comprising:

a rotary outer shell (1) including a ventilation rod body (1-1) and air duct cover sheets (1-2), the ventilation rod body including a plurality of arc-shaped plates (1-1-1) and a plurality of elongated segments, where the plurality arc-shaped plated and the plurality of elongated segments are arranged in an alternating manner such that their respective inner and outer surfaces are continuous and define inner and outer surfaces of the rotary outer shell, each elongated segment of the plurality of elongated segments having a first fixing groove (1-1-2) extending along the length thereof and being disposed between two adjacent ones of the arc-shaped plates (1-1-1), wherein each of the first fixing grooves includes a first row of air outlets (1-1-3) on a first side of the fixing groove and a second row of air outlets (1-1-3) on a second side of the fixing groove opposite the first side, and each outlet of the first and second rows of air outlets extends through the thickness of the rotary outer shell to provide air exits on the outer surface;

each of the air duct cover sheets (1-2) has an inner surface including a row of first fixing strips (1-2-1), a row of second fixing strips (1-2-2), and a second fixing groove (1-2-3) disposed between the row of the first fixing strips (1-2-1) and the row of the second fixing strips (1-2-2), wherein each air duct cover sheet is secured to one of a plurality of partition blocks disposed on the outer surface of the rotary shell between the air exits of the first and second rows of air outlets;

a rotating body (2) partially disposed in the rotary outer shell (1) and including a plurality partition plates (2-1) disposed on an outer surface and movably disposed in the first fixing grooves (1-1-2), and a ventilation bottom cover (2-2) disposed at a first end of the rotating body (2) and disposed externally of the rotary outer shell (1); and a fixing knob (3) disposed at a second end of rotary outer shell (1) and connected with a second end of the rotating body (2) wherein, the rotating body rotates between a first position and a second position, where in the first position, the plurality of partition plates cover the second rows of air outlets such that air traveling through the rotating body and rotary outer shell exits through the first rows of air outlets to curl hair in a first direction, and in the second position, the plurality of partition plates cover the first rows of air outlets such that air traveling through the rotating body and rotary outer shell exits through the second rows of air outlets to curl hair in a second direction.

* * * * *